US009200600B1

(12) United States Patent
Taylor et al.

(10) Patent No.: US 9,200,600 B1
(45) Date of Patent: Dec. 1, 2015

(54) METHOD FOR CONTROLLING A FUEL SYSTEM OF A MARINE PROPULSION ENGINE

(71) Applicant: Brunswick Corporation, Lake Forest, IL (US)

(72) Inventors: Christopher J. Taylor, Fond du Lac, WI (US); Brian L. Merten, St. Cloud, WI (US); Matthew W. Snyder, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 44 days.

(21) Appl. No.: 13/954,105

(22) Filed: Jul. 30, 2013

Related U.S. Application Data

(63) Continuation of application No. 11/434,090, filed on May 15, 2006, now abandoned.

(51) Int. Cl.
*F02M 25/08* (2006.01)
*F02D 41/24* (2006.01)
*F02B 1/04* (2006.01)

(52) U.S. Cl.
CPC ..... *F02M 25/08* (2013.01); *F02B 1/04* (2013.01); *F02D 41/2454* (2013.01)

(58) Field of Classification Search
CPC ..... F02M 25/08; F02B 1/04; F02D 41/2454; F02D 41/2464
USPC ..... 123/520
See application file for complete search history.

(56) References Cited

U.S. PATENT DOCUMENTS

| | | | | |
|---|---|---|---|---|
| 3,835,822 | A | 9/1974 | Mickle et al. | |
| 4,683,861 | A * | 8/1987 | Breitkreuz et al. | 123/698 |
| 4,844,043 | A | 7/1989 | Keller | |
| 5,103,793 | A | 4/1992 | Riese et al. | |
| 5,231,958 | A | 8/1993 | Takahashi et al. | |
| 5,389,245 | A | 2/1995 | Jaeger et al. | |
| 6,253,742 | B1 | 7/2001 | Wickman et al. | |
| 6,253,744 | B1 * | 7/2001 | Saruwatari et al. | 123/520 |
| 6,321,735 | B2 | 11/2001 | Grieve et al. | |
| 6,390,871 | B1 * | 5/2002 | Wickman et al. | 440/88 R |
| 6,553,974 | B1 | 4/2003 | Wickman et al. | |
| 6,694,955 | B1 | 2/2004 | Griffiths et al. | |
| 6,718,953 | B1 | 4/2004 | Torgerud | |
| 7,124,021 | B2 | 10/2006 | Moskwa et al. | |
| 7,263,969 | B2 | 9/2007 | Sakamoto | |
| 7,367,326 | B2 | 5/2008 | Shikama et al. | |
| 2004/0045538 | A1 | 3/2004 | Tagami et al. | |

FOREIGN PATENT DOCUMENTS

| | | |
|---|---|---|
| EP | 0 322 790 | 7/1989 |
| EP | 1 308 604 | 5/2003 |
| JP | 2001-140720 | 5/2001 |

* cited by examiner

*Primary Examiner* — Lindsay Low
*Assistant Examiner* — Kevin Lathers
(74) *Attorney, Agent, or Firm* — Andrus Intellectual Property Law, LLP

(57) ABSTRACT

A fuel management system for a marine propulsion device provides a series of intermediate venting commands to a canister purge valve which controls the pressure decay within a fuel supply module in such a way that both the lift pump and high pressure pump within the module are provided with appropriate pressures to allow them to operate satisfactorily.

12 Claims, 3 Drawing Sheets

| RPM | 700 | 1200 | 1850 | 2440 | 3050 | 3660 | 4270 | 4880 | 6100 |
|---|---|---|---|---|---|---|---|---|---|
| DUTY CYCLE | 60.0 | 50.0 | 50.0 | 55.005 | 55.005 | 64.99 | 75.0 | 80.005 | 80.0 |

FIG. 2

METHOD FOR CONTROLLING A FUEL SYSTEM OF A MARINE PROPULSION ENGINE

CROSS REFERENCE TO RELATED APPLICATION

This application is a continuation of U.S. patent application Ser. No. 11/434,090, filed May 15, 2006, which is incorporated by reference in its entirety.

BACKGROUND OF THE INVENTION

1. Field of the Invention

The present invention is generally related to a method for controlling a fuel system of a marine propulsion engine and, more particularly, to a method for controlling a canister purge valve in order to manage the fuel vapor associated with a fuel supply module.

2. Description of the Related Art

Many different types of fuel handling systems associated with marine propulsion systems are well known to those skilled in the art. Fuel vapor separators and other types of fuel system modules are used to segregate fuel vapor from liquid fuel and to direct the fuel vapor away from fuel pumps whose operation can be adversely affected by the presence of vapor within the fuel supply.

U.S. Pat. No. 3,835,822, which issued to Mickle et al. on Sep. 17, 1974, discloses a cooled fuel pump for internal combustion engines. The pump includes a cast aluminum housing. A water cooling tube is embedded in the housing and connected directly to the inlet of the main cooling system of the engine such that upon initial starting of the engine, cooling water is immediately supplied to the fuel pump to reduce its temperature, and thereby eliminate vapor lock conditions.

U.S. Pat. No. 4,844,043, which issued to Keller on Jul. 4, 1989, discloses an anti-vapor lock carbureted fuel system. A marine fuel system includes a first crankcase pressure driven fuel pump supplying fuel from a remote fuel tank to a vapor separator, and a second crankcase pressure driven fuel pump supplying vapor-free fuel from the vapor separator to the carburetors of the engine. In combination, a squeeze bulb and one-way check valve supply fuel from the remote fuel tank directly to the carburetors for starting the engine.

U.S. Pat. No. 5,103,793, which issued to Riese et al. on Apr. 14, 1992, discloses a vapor separator for an internal combustion engine. The assembly includes a bowl member and a cover member. A fuel pump is located in the internal cavity of the bowl member and has its inlet located in the lower portion of the bowl member cavity, for supplying fuel thereto. The fuel pump is secured in position within the bowl member by engagement of the cover member with a fuel pump. The cover member includes a mounting portion for mounting a water separating filter element to the vapor separator assembly. The cover member includes structure for routing fuel from the discharge of the water separating filter element to the interior of the bowl member internal cavity.

U.S. Pat. No. 5,389,245, which issued to Jaeger et al. on Feb. 14, 1995, discloses a vapor separating unit for a fuel system. The unit includes a closed tank having a fuel inlet through which fuel is fed to the tank by a diaphragm pump. The liquid level in the tank is controlled by a float-operated valve. An electric pump is located within the vapor separating tank and has an inlet disposed in the tank and an outlet connected to a fuel rail assembly of the engine. Excess fuel from the fuel rail assembly is conducted back to the upper end of the vapor separator tank. A vapor venting mechanism is incorporated in the tank to vent vapor from the tank.

U.S. Pat. No. 6,253,742, which issued to Wickman et al. on Jul. 3, 2001, discloses a fuel supply method for a marine propulsion engine. The method uses a lift pump to transfer fuel from a remote tank to a vapor separator tank. Only one level sensor is provided in the vapor separator tank and an engine control unit monitors the total fuel usage subsequent to the most recent filling of the tank. When the fuel usage indicates that the fuel level of the vapor separator tank has reached a predefined lower level, a lift pump is activated to draw fuel from a remote tank and provide that fuel to the vapor separator tank.

U.S. Pat. No. 6,553,974, which issued to Wickman et al. on Apr. 29, 2003, discloses an engine fuel system with a fuel vapor separator and a fuel vapor vent canister. The system provides an additional fuel chamber, associated with a fuel vapor separator, that receives fuel vapor from a vent of the fuel vapor separator. In order to prevent the flow of liquid fuel into and out of the additional fuel chamber, a valve is provided which is able to block the vent of the additional chamber. In addition, a sensor is provided to provide a signal that represents a condition in which liquid fuel within the additional fuel chamber exceeds a predetermined level.

U.S. Pat. No. 6,694,955, which issued to Griffiths et al. on Feb. 24, 2004, discloses a marine engine with primary and secondary fuel reservoirs. The system comprises first and second fuel reservoirs connected in fluid communication with each other. The first fuel reservoir is a fuel vapor separator which has a vent conduit connected in fluid communication with a second fuel reservoir. Under normal conditions, fuel vapor flows from the fuel vapor separator and into the second fuel reservoir for eventual discharge to the atmosphere. Any liquid fuel caused to flow out of the vent conduit of the fuel vapor separator is contained within the second fuel reservoir and prevented from being discharged into the cavity under the cowl of an outboard motor and eventually into a body of water in which the marine system is operated.

U.S. Pat. No. 6,718,953, which issued to Torgerud on Apr. 13, 2004, discloses a fuel vapor separator with flow directing components within a fuel recirculating flow path. A fuel delivery system for a marine engine provides first, second, and third reservoirs of a fuel vapor separator and first, second, and third pumps to cause fuel to be drawn from the fuel tank and provided to the combustion chambers of an internal combustion engine. A flow directing component is provided to inhibit recirculated fuel from mixing directly with fuel within the fuel vapor separator that has not yet been pumped to a fuel rail. The flow directing component receives recirculated fuel and also receives fuel from a second reservoir through an orifice formed through a surface of the flow directing component.

The patents described above are hereby expressly incorporated by reference in the description of the present invention.

It would be significantly beneficial if a fuel system of a marine propulsion engine could control the pressure within a fuel reservoir, such as a fuel vapor separator or fuel system module, in such a way that both a lift pump and a high pressure pump within the fuel vapor separator can work properly with the pressure within the fuel system module.

SUMMARY OF THE INVENTION

A method for controlling a fuel system of a marine propulsion engine, in accordance with a particularly preferred embodiment of the present invention, comprises the steps of providing a flow control device, or purge valve, which is connected in fluid communication with a fuel reservoir of the fuel system, determining a desired venting command for venting gaseous fuel from the fuel reservoir, selecting a plurality of intermediate venting commands as a function of the desired venting command, and actuating the flow control device according to the selected plurality of intermediate venting commands.

In a particularly preferred embodiment of the present invention, the method comprises the further step of measuring an operating parameter of the marine propulsion engine. The determining step comprises the step of determining the desired venting command as a function of the operating parameter, which can be the operating speed of the marine propulsion engine. The method can further comprise the step of determining a current venting command associated with the flow control device. Each of the plurality of intermediate venting commands can be selected as a dual function of the desired venting command and the current venting command. The plurality of intermediate venting commands can comprise a series of sequentially increasing venting commands. The fuel reservoir can be a canister that is disposed in fluid communication between a fuel system module and an air intake manifold of the marine propulsion engine. The desired venting command can be a pulse width modulated (PWM) signal transmitted to the flow control device by a microprocessor. The plurality of intermediate venting commands can be a series of pulse width modulated signals transmitted to the flow control device, or canister purge valve, by the microprocessor at a predetermined frequency. In certain embodiments of the present invention, the fuel reservoir is a canister which is disposed in fluid communication between a fuel system module, or fuel vapor separator, and an air intake manifold of the marine propulsion engine. The fuel system module can comprise a lift pump and high pressure pump disposed therein. The lift pump is disposed in fluid communication with a fuel tank of a marine vessel and the high pressure pump is disposed in fluid communication with a fuel rail of the marine propulsion engine.

BRIEF DESCRIPTION OF THE DRAWINGS

The present invention will be more fully and completely understood from a reading of the description of the preferred embodiment in conjunction with the drawings, in which:

FIG. 2 is a table which shows representative duty cycles of a pulse width modulated system as a function of engine speed.

DESCRIPTION OF THE PREFERRED EMBODIMENT

Figure 1:
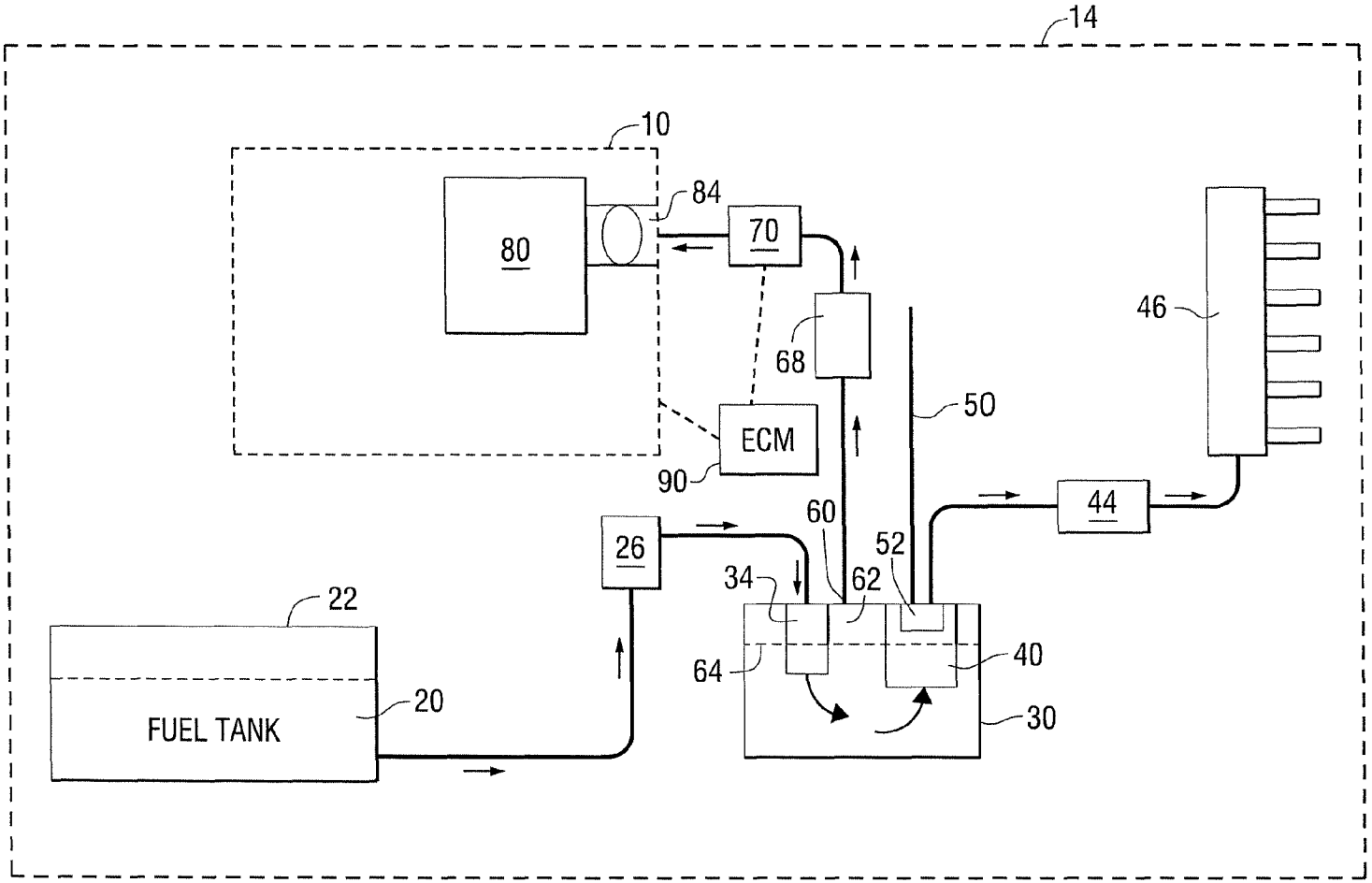
FIG. 1 is a highly schematic representation of a fuel system of a marine vessel.

Throughout the description of the preferred embodiment of the present invention, like components will be identified by like reference numerals.

In certain marine propulsion systems, a fuel supply module (FSM) is located under a cowl and in close proximity to the engine. As a result, it is located within an environment which can experience high temperatures during certain operating conditions. Particularly when a volatile fuel, such as winter blend gasoline, is used, high vapor pressure is created within the fuel supply module because of the vaporization of the fuel. If the vapor pressure is relieved rapidly, as is done in certain known fuel systems for outboard motors, the high pressure pump contained within the fuel supply module can become vapor locked because of an excess amount of vapor bubbles within the liquid fuel volume of a fuel supply module. The rapid decrease in pressure within the fuel supply module causes the bubbles to rapidly form. Another problem can exist in relation to the lift pump which can also be located within the fuel supply module. The lift pump, under certain circumstances, cannot properly draw fuel from the fuel tank of a marine vessel into the fuel supply module because of the high pressure that exists within the fuel supply module. Therefore, the high pressure pump requires pressure to be relieved slowly in order to avoid the creation of bubbles from the liquid fuel while the lift pump requires the pressure to be relieved quickly in order to assist the lift pump in drawing fuel from the fuel tank of the marine vessel. These two requirements are contradictory.

Another problem can exist when the operator of a marine vessel starts the engine, after the temperature of the fuel system is elevated, and then allows the engine to operate at idle speed. The engine has a finite limit of fuel vapor that it can ingest before the fuel/air mixture provided to the cylinders becomes too rich and causes a misfire condition to occur. Therefore, the vapor pressure must be relieved quickly enough within the fuel supply module so that the lift pump can replenish consumed fuel into the fuel supply module, but the vapor must be metered to the intake slowly enough such that the engine does not stall due to the rich air/fuel ratio.

Certain known fuel systems for marine engines utilize a canister located between the fuel supply module and an air intake manifold of the engine. The canister is intended to trap liquid fuel that escapes the FSM during the purging of fuel vapor. A valve is provided which allows a controlled flow of fuel vapor to pass from the FSM to the air intake module. In known fuel systems, the canister purge valve associated with a canister between the fuel supply module and the air intake manifold is a simple solenoid valve that is spring loaded to a closed position. When voltage is applied to the valve, the valve is forced open and vapor from the fuel supply module flows to the air intake manifold. A typical known strategy for use in this type of system incorporates a pulse width modulated (PWM) control signal at approximately ten Hertz and approximately an eighty percent duty cycle at rated engine speed. This type of calibration setting provides a very free flowing orifice to the vapor from the canister and causes a rapid pressure decay within the cavity of the fuel supply module. At idle engine speed, the same ten Hertz frequency is used, but at approximately a fifteen percent duty cycle. In other words, known fuel systems incorporate two duty cycles, one for idle speed and one at rated speed.

The present invention uses a more sophisticated control strategy which compensates for the tradeoff between the requirements of the high pressure pump and the lift pump. The present invention tailors the change in flow rate of fuel vapor through the canister purge valve to suit both the lift pump and the high pressure pump in such a way that both of these pumps are operated at acceptable pressures. The method of the present invention allows the pressure within the fuel supply module to decay slowly during a transient acceleration, giving the high pressure pump time to move the vapor through the system, but it then opens the canister purge valve to relieve the pressure rapidly allowing the lift pump to move the vapor, which is formed in the inlet filter, into the fuel supply module at near atmospheric pressure. This same strategy works favorably during extended idle operation, because the canister purge valve holds pressure within the fuel supply module and allows it to slowly decay over time. It then rapidly opens to allow the lift pump to provide fresh liquid fuel into the fuel supply module. This occurs through the use of software calibration in the determination of the venting profile as will be described in greater detail below.

FIG. 1 is a schematic representation of a typical fuel supply system for a marine vessel. Dashed line box 10 represents a marine engine and dashed line box 14 represents the marine vessel on which the other components are located. Fuel 20 is provided from a fuel tank 22 of the marine vessel 14, passed through an inlet fuel filter 26 and into a fuel supply module 30. This flow of liquid fuel 20 to the fuel supply module 30, or FSM, is induced by the use of a lift pump 34. A high pressure pump 40 draws liquid fuel from the fuel system module 30 and causes it to flow through a high pressure filter 44 and to a fuel rail 46 which provides fuel to a plurality of injectors of the engine 10. A manifold pressure reference line 50 is used so that a pressure regulator 52 can control the operation of the high pressure pump 40 to deliver pressure at a known desired magnitude to the fuel rail 46.

With continued reference to FIG. 1, a vent opening 60 directs fuel vapor from the ullage 62 above the fuel level 64 within the fuel supply module 30 and conducts it to a canister 68. The fuel vapor can flow through the canister 68 when a canister purge valve 70 is opened. As a result, the flow of fuel vapor from the ullage 62 of the fuel supply module 30 to the air intake manifold 80 of the engine 10 is controlled by the canister purge valve 70. When the canister purge valve 70 is opened, fuel vapor flows through a throttle body 84 and into the air intake manifold 80 of the engine 10. An engine control module 90 is used to control the operation of the canister purge valve 70. In addition, the engine control module 90 can provide control signals to the lift pump 34 and many other components of the marine propulsion system. In addition, the engine control module 90 can be provided with information relating to the operating speed of the engine 10 and various other parameters relating to the operation of the marine propulsion system.

The rate of fuel vapor flow through the canister purge valve 70 is advantageously controlled as a function of the operating speed of the engine 10. In known systems, as described above, the canister purge valve 70 is typically controlled in such a way that it is always in one of two states. A low flow state, in which the canister purge valve is provided with a relatively low duty cycle, such as fifteen percent, allows a minimal flow of vapor from the canister 68 to the air intake manifold 80. A high flow condition of the canister purge valve 70 allows an eighty percent duty cycle. This limited choice of high flow and low flow conditions of the canister purge valve is generally not sufficient to satisfy the most advantageous operating conditions of the lift pump 34 and high pressure pump 40.

FIG. 2 is a graphical representation of a table which identifies certain advantageous duty cycles for the canister purge valve 70 which are listed as a function of the operating speed of the engine 10. In other words, when the engine 10 is operating at seven hundred RPM, it has been determined that the lift pump 34 and the high pressure pump 40 operate most efficiently at a duty cycle of sixty percent for the canister purge valve 70. Similarly, when the engine is operating at four thousand two hundred and seventy RPM, a duty cycle of seventy-five percent is optimum. It should be understood that the duty cycles listed in the table of FIG. 2 are empirically determined to optimize the combined operation of both the lift pump 34 and the high pressure pump 40. Either of these two pumps may operate more advantageously under a different pressure profile within the fuel supply module 30, but the combined operation of the two pumps is optimized by calibrating the system as identified in FIG. 2.

With continued reference to FIGS. 1 and 2, the engine control module 90 measures the operating speed of the engine 10 and selects an associated duty cycle from the table in FIG. 2. It then operates the canister purge valve 70 at that selected duty cycle. The pulse width modulated signal provided by the engine control module 90 to the canister purge valve 70 is provided at a frequency of approximately five hundred Hertz, a frequency that is advantageous to the value.

As described above, systems known to those skilled in the art use canister purge valves 70 in association with canisters 68 and fuel supply modules 30. However, known systems use no more than two magnitudes of pulse width modulated signals for the canister purge valve 70. In other words, the canister purge valve 70 is operated either at a low flow rate or a high flow rate. Although the low flow rate may be greater than zero, it is typically selected to provide a minimal vapor flow to vent the fuel supply module 30 at a slow rate. Accordingly, the high flow rate is selected to provide maximum venting of the ullage 62 when the engine 10 is operating at higher speeds.

Rather than limit the system in this way, the present invention provides multiple magnitudes of signals from the engine control module 90 to the canister purge valve 70 in order to tailor, or calibrate, the rate of pressure decay within the fuel supply module 30 which adequately suits the needs of both the lift pump 34 and the high pressure pump 40.

It should be understood that the terminology used to describe the present invention utilizes the term "plurality" in conjunction with the steps of intermediate venting commands to mean more than simply a low venting rate and a high venting rate. It is recognized that the low and high venting rates of the prior art comprise two rates and, as such, can be considered to be a "plurality", but the use of that terminology in the description of the present invention is intended to incorporate within its meaning more than simply a low rate and a high rate or, alternatively, an off condition and an on condition. Instead, the term "plurality" is intended to incorporate within its meaning the use of two or more duty cycle commands above the minimal duty cycle which, in known systems, would either be zero percent duty cycle or, in the example described above, a fifteen percent duty cycle. Since that minimal duty cycle is considered herein to be essentially insignificant venting, it will be considered to be generally equivalent to a zero duty cycle. Therefore, the use of the term "plurality" in conjunction with the number of intermediate venting commands or steps of the method of the present invention shall mean at least two magnitudes of venting commands above the minimal magnitude and including the maximum magnitude. This use of the term "plurality" will be clear from the following description of the preferred embodiment of the present invention.

Figure 3:
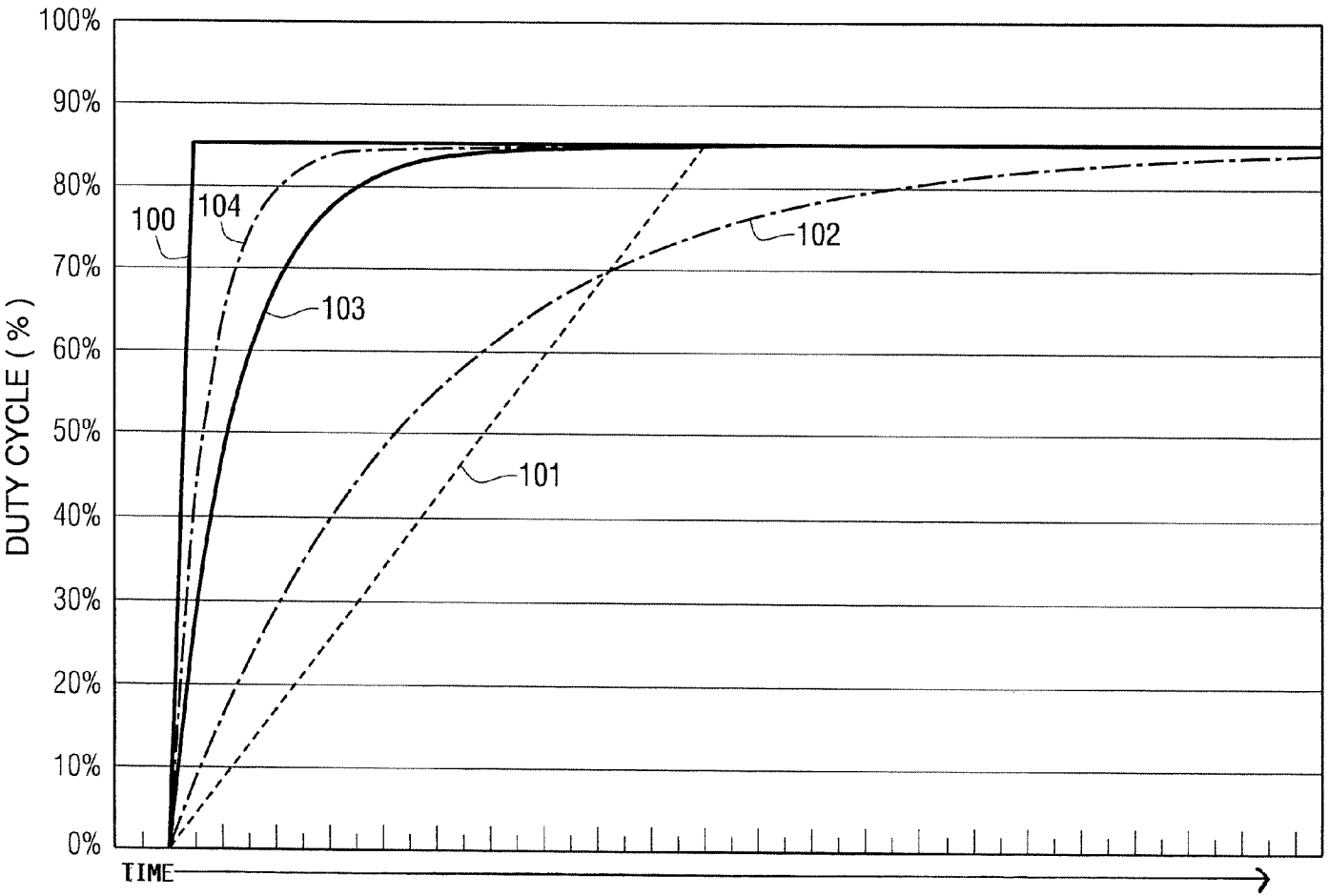
FIG. 3 shows various lines that represent the rate of change of duty cycle commands for both the prior art and various embodiments of the present invention.

In FIG. 3, the percentage duty cycle of the signal provided by the engine control module 90 to the canister purge valve 70 is graphically represented as a function of time for five different circumstances which are represented by the five lines in FIG. 3. Line 100 in FIG. 3 represents a step function which is generally known to those skilled in the art and which is described above. In other words, at the time of zero in FIG. 3, the pulse width modulated signal from the engine control module 90 to the canister purge valve 70 changes instantaneously from zero percent to eighty-five percent. Alternatively, some known systems would change the duty cycle from fifteen percent to eighty percent, but the specific magnitudes of the minimal and maximum venting flow rates are both known to those skilled in the art. The important aspect of line 100 is that it comprises two magnitudes of duty cycle which represents the low venting flow rate and the high venting flow rate.

With continued reference to FIGS. 1-3, it should be understood that various embodiments of the present invention can incorporate different rates of change of the venting flow rate through the canister purge valve 70 as a function of different engine speeds and different operating conditions of the engine. Dashed line 101 in FIG. 3 represents a constant change, over time, of the duty cycle transmitted from the engine control module 90 to the canister purge valve 70. Under this type of system, each subsequent transmission of a pulse width modulated signal from the engine control module 90 to the canister purge valve 70 is slightly greater than the proceeding one and the series of signals represents a plurality of steps in which each step represents an intermediate venting command that is greater than the proceeding step and each of the steps changes by an equal magnitude relative to its preceding step. This results in a constant rate of change of the duty cycle.

With continued reference to FIG. 3, the example relating to line 101 assumes that a desired venting command of eighty-five percent is the target selected from the table in FIG. 2. However, it should be understood that the duty cycles illustrated in FIG. 2 are exemplary and are suited for one particular type of engine. The duty cycles can change significantly for different types of engines and different operating conditions. In FIG. 3, it is also assumed that the current duty cycle is zero percent prior to the change. In reality, however, it should be understood that the techniques of the present invention can be used in changing the duty cycle command from a first or initial duty cycle to a desired or final duty cycle regardless of the specific magnitudes of the initial and final duty cycles.

Line 102 in FIG. 3 represents a much more gradual change from the initial to the final duty cycles. The shape of line 102 results from the fact that each incremental change in the magnitude of the pulse width modulated signal provided by the engine control module 90 is a function of the current magnitude and the difference between the desired magnitude and the current magnitude. As an example, line 102 can be created if each subsequent step is ten percent of the remaining magnitude between the current venting command and the desired venting command of eighty-five percent. Similarly, line 103 can be the result of a similar mathematical relationship, but with each subsequent step being thirty-three percent of the remaining magnitude between the current magnitude and the desired magnitude. Finally, line 104 is similarly achieved if each step is fifty percent of the remaining magnitude between the current magnitude and the final, or desired venting command.

It can be seen that the various rates of closure between the current venting command from the engine control module 90 and the desired magnitude of eighty-five percent can be tailored to suit the characteristics of both the lift pump 34 and the high pressure pump 40. It should be understood, however, that each marine propulsion system may require different rates of pressure decay within the fuel supply module 30. The present invention provides a technique which allows different operating characteristics of different lift pumps and high pressure pumps to be accommodated by selectively controlling the rate of pressure decay within the fuel supply module.

It should be understood that the illustration in FIG. 3 is intended to illustrate the change in duty cycle, over time, for a system that is experiencing a continuously increasing engine speed. In other words, all of the lines, 100-104, in FIG. 3 eventually reach an eighty-five percent duty cycle in this exemplary illustration. This implies that, over a period of time, the engine speed reaches a magnitude that requires this eighty-five percent duty cycle. However, it should be clearly understood that operating the engine at a speed, for example, of 2440 RPM for a prolonged period of time would result in a generally constant duty cycle of approximately fifty-five percent if the relationships represented in FIG. 2 is used. That duty cycle would be maintained until the engine speed is changed. Therefore, the graphical representation in FIG. 3 should be understood to represent the various duty cycle profiles under conditions where the engine speed is continually increased over a preselected period of time (e.g. 30-70 seconds) represented in the Figure. On the other hand, maintaining an engine speed less than maximum engine speed would result in a generally constant duty cycle, as indicated in FIG. 2 for that representative engine speed.

With reference to FIGS. 1-3, it can be seen that a method for controlling a fuel system of a marine propulsion engine comprises the steps of providing a flow control device 70, or canister purge valve, which is connected in fluid communication with a fuel reservoir 30 of a fuel system. It further comprises the step of determining a desired venting command, such as through the use of the table in FIG. 2, for venting gaseous fuel from the fuel reservoir 30. A plurality of intermediate venting commands is then selected as a function of the desired venting command (i.e. eighty-five percent) and, in certain situations, a current venting command. It also comprises the step of actuating the flow control device 70 according to the selected plurality of intermediate venting commands.

The method of the present invention provides a flow control device 70, or canister purge valve, that is connected in fluid communication with a fuel reservoir 30 of the fuel system. It then determines a desired venting command, such as through the use of the table in FIG. 2, for venting gaseous fuel from the fuel reservoir 30. It then selects a plurality of intermediate venting commands as a function of the desired venting command. In operation, each of the intermediate venting commands can be calculated dynamically as the various intermediate duty cycle commands are transmitted by the engine control module 90. Each of these intermediate commands is then used to select the subsequent command which can be chosen as a function of the difference between the most recently transmitted command and the desired command of eighty-five percent. In this way, the shape of the line, 101-104, in FIG. 3 can be specifically selected to satisfy the optimum conditions for both the lift pump 34 and the high pressure pump 40.

Although the present invention has been described with particular specificity and illustrated to show various preferred embodiments, it should be understood that alternative embodiments are also within its scope.

We claim:

1. A method for controlling a fuel system of a marine propulsion engine, comprising the steps of:

providing a flow control device which is connected in fluid communication with a fuel reservoir of said fuel system;

measuring an operating speed of said marine propulsion engine;

determining a desired venting command for venting gaseous fuel from said fuel reservoir to a point upstream from a throttle valve disposed within a throttle body, wherein said desired venting command is determined as a function of said measured operating speed;

selecting a plurality of intermediate venting commands as a function of said desired venting command and of a current venting command associated with a previous operating speed of said marine propulsion engine, wherein said plurality of intermediate venting commands comprises a series of venting commands that sequentially increase from said current venting command to said desired venting command, and wherein each intermediate venting command in said plurality of intermediate venting commands is determined based on a remaining difference between an immediately preceding intermediate venting command and said desired venting command; and actuating said flow control device according to said selected plurality of intermediate venting commands.

2. The method of claim 1, wherein:

said fuel reservoir is a canister disposed in fluid communication between a fuel system module and an air intake manifold of said marine propulsion engine.

3. The method of claim 1, wherein:

said desired venting command is a pulse width modulated signal transmitted to said flow control device by a microprocessor.

4. The method of claim 3, wherein:

said plurality of intermediate venting commands is a series of pulse width modulated signals transmitted to said flow control device by said microprocessor at a predetermined frequency.

5. The method of claim 1, wherein:

said fuel reservoir is a canister disposed in fluid communication between a fuel system module and an air intake manifold of said marine propulsion engine, said fuel system module comprising a lift pump and a high pressure pump disposed therein, said lift pump being disposed in fluid communication with a fuel tank, said high pressure pump being disposed in fluid communication with a fuel rail of said marine propulsion engine.

6. A method for controlling a fuel system of a marine propulsion engine, comprising the steps of:

providing a fuel system module having a lift pump and a high pressure pump disposed therein, said lift pump being connected in fluid communication with a fuel tank of a marine vessel, said high pressure pump being connected in fluid communication with a fuel rail of said marine propulsion engine;

providing a canister connected in fluid communication between said fuel system module and an air intake manifold of said marine propulsion engine;

providing a purge valve connected in fluid communication between said canister and a point upstream from a throttle valve disposed within a throttle body which is connected to said air intake manifold;

determining a desired flow rate command for said purge valve by inputting a measured operating speed of said marine propulsion engine into a table that relates a plurality of engine operating speeds to a plurality of empirically determined desired flow rate commands that optimize operation of both said lift pump and said high pressure pump; and selecting a plurality of intermediate flow rate commands to sequentially change a flow rate through said purge valve from a current flow rate command associated with a previous operating speed of said marine propulsion engine to said desired flow rate command associated with said measured operating speed over a preselected period of time.

7. The method of claim 6, wherein:

said plurality of intermediate flow rate commands represents a series of generally equal incremental steps.

8. The method of claim 6, wherein:

said plurality of intermediate flow rate commands represents a series of sequential incremental steps of decreasing magnitude.

9. A method for controlling a fuel system of a marine propulsion engine, comprising the steps of:

providing a flow control device which is connected in fluid communication with a fuel reservoir of said fuel system;

determining a desired venting command for venting gaseous fuel from said fuel reservoir to a point upstream from a throttle valve disposed within a throttle body, wherein said desired venting command is determined as a function of a measured operating speed of said marine propulsion engine;

selecting a plurality of intermediate venting commands as a function of said desired venting command associated with said measured operating speed, and as a function of a current venting command associated with a previous operating speed of said marine propulsion engine, said plurality of intermediate venting commands representing a series of sequential steps which increase a flow rate through said flow control device from an initial flow rate associated with said current venting command to a desired final flow rate associated with said desired venting command over a predetermined period of time, wherein each of said series of sequential steps is of less magnitude than an immediately preceding one of said series of sequential steps; and actuating said flow control device according to said selected plurality of intermediate venting commands.

10. The method of claim 9, wherein:

said fuel reservoir is a canister connected between a fuel system module and an air intake manifold of said marine propulsion engine.

11. The method of claim 10, further comprising:

providing a lift pump connected in fluid communication with a fuel tank of a marine vessel; and providing a high pressure pump connected in fluid communication with a fuel rail of said marine propulsion engine, said lift and high pressure pumps being disposed within said fuel system module.

12. The method of claim 9, wherein:

said flow control device is a canister purge valve.

* * * * *